United States Patent [19]

Neu

[11] 4,059,231

[45] Nov. 22, 1977

[54] METHOD AND APPARATUS FOR SELECTIVELY COMMINUTING PARTICLES OF A FRANGIBLE MATERIAL

[75] Inventor: Ernest L. Neu, Redondo Beach, Calif.

[73] Assignee: Grefco, Inc., Bala Cynwyd, Pa.

[21] Appl. No.: 705,997

[22] Filed: July 16, 1976

[51] Int. Cl.[2] ..... B02C 19/06

[52] U.S. Cl. ..... 241/5; 241/40

[58] Field of Search ..... 241/5, 14, 40

[56] References Cited

U.S. PATENT DOCUMENTS

| | | | |
|---|---|---|---|
| 1,046,290 | 12/1912 | Granville | 241/40 |
| 2,054,280 | 9/1936 | Brown | 241/40 |
| 2,798,674 | 7/1957 | Denning | 241/5 |
| 3,701,484 | 10/1972 | Donovan | 241/5 |
| 3,876,156 | 4/1975 | Muschelknautz et al. | 241/5 |

*Primary Examiner*—Granville Y. Custer, Jr.
*Attorney, Agent, or Firm*—Everett H. Murray, Jr.; Brian G. Brunsvold; Bruce C. Zotter

[57] ABSTRACT

A method and apparatus for selectively comminuting particles of a frangible material for the production of filter aid, the apparatus including an air-conveying system for carrying entrained particles of varying masses, a venturi for accelerating the air stream and entrained particles, a duct for receiving the accelerated air stream and particles, and impact bars mounted in the duct for selectively fragmenting the entrained particles. The impact bars are positioned in the accelerated air stream to establish adverse pressure fields which classify the entrained particles and which provide impact surfaces to fragment particles greater than a predetermined mass, the rest of the particles being deflected around the bars by the action of the adverse pressure fields.

16 Claims, 4 Drawing Figures

METHOD AND APPARATUS FOR SELECTIVELY COMMINUTING PARTICLES OF A FRANGIBLE MATERIAL

BACKGROUND OF THE INVENTION

1. Field of the Invention

This invention pertains to an apparatus and method for comminuting particles of a frangible material, and particularly for the production of filter and material, by impact milling.

2. Description of the Prior Art

Filter aids of the present type are finely divided solids of inert materials, like diatomaceous earth or expanded perlite, of such particle size and shape as to form a filter bed or cake of such porosity and permeability as to permit fairly free passage of liquids without allowing the passage of any of the solids which are to be removed from the liquid.

The function of a filter aid of the type here involved is to maintain the porosity and permeability of a filter, to increase the rate of flow, and to assist in clarifying the liquid. High flow rate through the filter coupled with high clarity of the filtrate requires close control over size and shape of the filter aid particle.

There are several known types of apparatus for milling particles of a frangible material into small sizes. Among these are the hammer or ball mill, and the impact mill, including the jet and anvil mill. Each of these mills has certain advantages and disadvantages for grinding particular types of materials to different particle size ranges. For example, impact milling, where the coarse particles are accelerated to a high velocity and allowed to impact against each other or against an anvil-like memeber, is advantageously used in the low range for dry grinding, as compared to a ball mill. In the case of a ball mill, the material and balls are surrounded by an air film when the material approaches the extremely fine, dry state. Material is squeezed out from between the balls and therefore eludes further grinding. Stated otherwise, the air film seems to work as a cushion to protect the material from further comminution.

The U.S. Pat. No. 2,798,674 to Denning discloses a method for filter aid production and shows an impact milling apparatus wherein the particles are accelerated by a rotating impeller and allowed to impact against a stationary plate. In the Denning process, the impacted material is collected and screened, and the coarse particles are returned to the apparatus for further impacting until substantially all of the particles are less than a predetermined size.

While the apparatus shown in Denning is suitable for comminuting particles of frangible materials as well as filter aid preparation, high-speed rotating equipment, in general, has a high initial cost due in part to the manufacturing tolerances required to insure vibration-free operation. The abrasive nature of some of the materials comminuted requires that the bearings of the rotating parts have special shielding to prevent premature bearing failure, which shielding can increase the complexity of the design and, consequently, the cost. Also, some impeller bearing mounting configurations used in the rotary impact millers of the type shown by Denning require periodic shut-downs for maintenance which can contribute substantially to the overall production costs.

Another type of impact milling apparatus, and one which does not utilize expensive rotary equipment to accelerate the particles, is the jet and anvil mill. In the jet and anvil mills, the particles of material to be comminuted are aspirated into a linear jet, accelerated by the action of the jet to a high velocity and thereafter are projected against an anvil causing fragmentation of the particles. Examples of apparatus utilizing the jet and anvil principle are found in U.S. Pat. Nos. 3,876,156 and 3,688,991.

The U.S. Pat. No. 3,876,156 to Muschelknautz et al., discloses apparatus for accelerating particles of a frangible solid in a linear jet-tube and then impacting them either against a stationary anvil or against similarly accelerated particles traveling in the opposite direction. A diffusor section is provided to create a rarified wherein the pressure head build-up on the anvil is minimized and whereby fewer particles will be deflected by the pressure head and carried past the anvil by the jet stream without impacting and without being comminuted. The relatively high jet speeds employed in comminuting apparatus of the type shown in Muschelknautz et al. in an effort to overcome the effects of the pressure head usually are reflected in higher costs for equipment and for power expenditures. The device shown in FIG. 1 of the Muschelknautz et al. reference is designed to operate in the sonic range, that is, with gas speeds > Mach 1. Friction losses tend to increase dramatically for speeds > Mach 0.3.

The U.S. Pat. No. 3,688,991 to Andrews discloses apparatus for impinging particles accelerated by a jet against a plurality of rotating anvils which are alternately introduced into, and then removed from, the jet. The rotating anvil apparatus of Andrews is intended to minimize the adverse pressure head buildup on each individual anvil and thus serve to increase the momentum of the particles at impact and decrease the number of particles deflected around the anvil by the diverging jet stream. Again, as in the apparatus shown in Denning, the use of rotating equipment can result in increased costs.

It is clear from the foregoing that those skilled in the art of comminuting frangible particles, using apparatus incorporating the jet and anvil principle, have gone to considerable lengths to minimize or eliminate the effect of the adverse pressure heads built up on stationary anvils. Therefore, a method and apparatus of comminuting which would not only tolerate but actually utilize this hydraulic phenomenon could be expected to result in substantial cost savings due to a decrease in the complexity of the comminuting apparatus and a reduction in the required power input.

BRIEF SUMMARY OF THE INVENTION

In accordance with the present invention as embodied and broadly described herein, the objects and advantages of which invention will be set forth in part in the description which follows, and in part will be obvious from the descriptions or may be learned by practice of the invention, an apparatus is provided for selectively comminuting particles of a frangible material. The apparatus comprises an air-conveying means for carrying entrained frangible material particles of varying masses; means for accelerating the air stream and the entrained particles; and anvil means for establishing a plurality of adverse pressure fields in said accelerated air stream for differentiating said entrained particles according to mass and for impacting particles above a predetermined mass and for by-passing the rest of the particles, the impacted particles fragmenting upon impact and thereby being comminuted.

Preferably, the accelerating means includes a venturi communicating with the air-conveying system and a duct which is fluidly connected to the exit of the venturi, the impacted and fragmented particles becoming re-entrained in the accelerated air stream and being carried through the duct together with the by-passed particles in the accelerated air stream. It is also preferred that the longitudinal axis of the duct is substantially linear and that the cross-sectional area of the duct is substantially constant along the longitudinal axis.

It is also preferred that the frangible material particles are acclerated to a velocity above 4000 fpm and to a velocity of about 4000 - 10,000 fpm.

It is also preferred that the anvil means includes a plurality of spaced impact bars grouped to form at least one row which is oriented substantially perpendicular to the longitudinal axis of the duct; that the characteristic impact dimension of the bars is about 1.0 inch; and that the spacing of the bars, centerline-centerline, is about 2.0 inches.

It is also preferred that the apparatus contain a plurality of rows of impact bars spaced along the longitudinal axis of the duct with the bars in any two adjacent rows being in staggered relationship; that the bars have a characteristic impact dimension of about 1.0 inch; that the bars have a centerline-centerline spacing of about 2.0 inches in each row; and that a centerline-centerline spacing of about 2.0 inches exits between adjacent rows.

Also, in accordance with the present invention, as embodied and broadly described herein, a method is provided for selectively comminuting particles of a frangible material being carried in an air-conveying system, the method comprising the steps of accelerating the particles to a high velocity in a substantially linear stream; establishing a plurality of adverse pressure fields for classifying the particles within the air stream into a plurality of first fractions and second fractions, the first fractions including substantially all particles having a mass greater than a predetermined value, and the second fractions including the rest of the particles; impacting the particles in the first fractions against stationary anvil means, the particles in the second fractions by-passing the anvil means; and recombining the impacted particles in the first fractions with the by-passed particles in the second fractions in the linear air stream.

Preferably, the particles are accelerated to a velocity above 4000 fpm, and to a velocity of about 4000 - 10,000 fpm.

It is also preferred that the steps of establishing adverse pressure fields, impacting, and recombining are repeated until the masses of substantially all of the particles in the first fractions are reduced below the predetermined value.

The accompanying drawing, which is incorporated in, and constitutes a part of, this specification illustrates one embodiment of the invention, and, together with the description, serves to explain the principles of the invention.

DESCRIPTION OF THE PREFERRED EMBODIMENT

Figure 1:
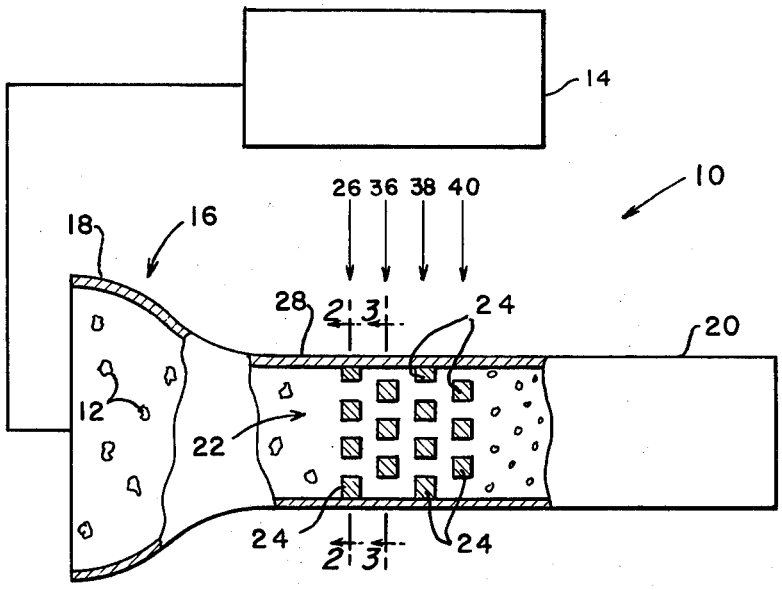
FIG. 1 is a view of the impact milling apparatus of this invention.

Reference will now be made in detail to the present preferred embodiment of the invention, an example of which is illustrated in the drawing.

In accordance with the invention, and as best seen in FIG. 1 of the drawing, apparatus 10 for selectively comminuting particles 12 of a frangible material such as that suitable for the production of a filter aid product, includes an airconveying means 14 for entrained particles of varying masses. The air-conveying means 14 is well known in the art of transporting particulate matter, and the particular size, configurations and arrangements of the system for a given application, material composition, load, etc., can be readily determined by one of ordinary skill in the art.

In accordance with the invention, the apparatus 10 also includes means 16 for accelerating the air stream and the entrained particles 12 to a high velocity. As embodied herein, the accelerating means 16 includes a venturi 18 which receives the air stream and entrained particles from the air-conveying means 14, wherein the acceleration is accomplished by the conversion of a pressure differential according to Bernoulli's principle. Preferably, the accelerating means 16 is capable of accelerating the air stream and entrained particles 12 to a velocity above 4000 fpm and to a velocity of about 4000 - 10,000 fpm. Tests have shown that suitable filter aid material can be produced from expanded perlite particles accelerated to velocities in this range and then impacted to cause fragmentation. For the instance wherein the venturi 18 is a part of the accelerating means 16, the size and capacity of both the air-conveying means 14 and the venturi 18 must be taken into account in a known manner to provide the sought-after velocities.

In accordance with the invention, the apparatus 10 also includes a duct 20 communicating with the accelerating means 16. Duct 20 is substantially linear along its longitudinal axis and has a substantially constant cross-sectional area. The use of a linear flow passage without abrupt flow area changes is the most efficient configuration for systems having gas or liquid flow in that the form losses, that is, unrecoverable pressure drops which arise in curved flow passageways and in channels with sudden, abrupt changes in flow area, minimized. When duct 20 is used with venturi 18, it can be fluidly connected to the exit of the venturi 18 or formed as an extension of the exit to effect a smooth flow area transition and to further minimize form losses.

In accordance with the invention, anvil means 22 is mounted in duct 20 for establishing a plurality of adverse pressure fields for differentiating particles 12 according to mass and for impacting particles above a predetermined mass and for by-passing the rest of the particles 12. As embodied herein, the stationary anvil means 22 includes a plurality of spaced impact bars 24 grouped to form at least one row 26, the row 26 being oriented substantially perpendicular to the longitudinal axis of duct 20. The bars 24 can be mounted directly on the wall 28 of duct 20, or they can be mounted on a frame 30 and inserted into duct 20 through suitably sized and spaced aperatures 32 in the duct wall 28.

Figure 4:
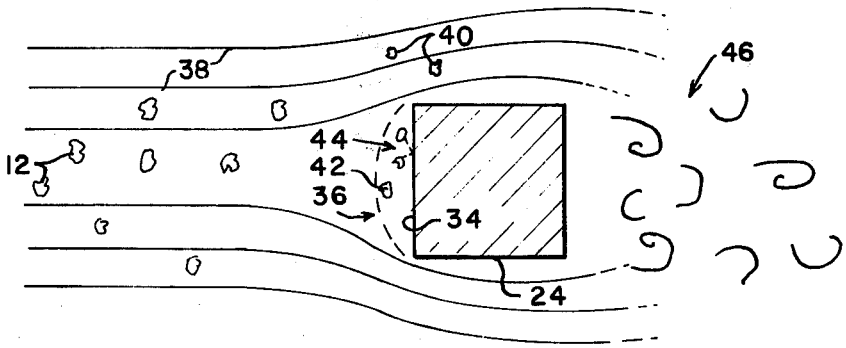
FIG. 4 is a schematic representation of the operation of a part of the invention.

With reference to FIG. 4 which depicts schematically the movement of the accelerated air stream in the vicinity of one of the impact bars 24 located in duct 20, the bars will cause pressure "heads" 36 to be built up and maintained in a known manner on the upstream faces 34 of the spaced bars, which faces are also the impact surfaces of the bars. These pressure heads are highly local regions of stagnant air which is either non-flowing or flowing extremely slowly with respect to the accelerated air stream. These regions have an ambient pressure significantly higher than that which exists in the surrounding air stream, a phenomenon which is known and whose magnitude can be calculated using the Bernoulli relationship.

These pressure heads present an adverse pressure field to the flowing air and the entrained-but-unclassified particles 12 incident upon the regions immediately upstream of the faces 34 causing the stream lines 38 of the air-stream to diverge. These adverse pressure fields will tend to deflect particles 12 to a degree corresponding to the varying masses of the particles. Particles 40, for example, of a mass less than a predetermined value are deflected around the bars 24 without impacting while the remaining particles 42 penetrate the fields and impact the bars 24 with energies sufficient to cause fragmentation, as is depicted at 44. The manner in which these adverse pressure fields serve to selectively differentiate the particles will be set forth with additional detail when the operation of apparatus 10 is described hereinafter.

Figure 2:
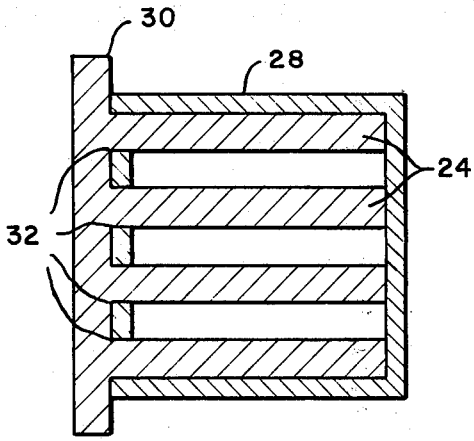
FIG. 2 is a cross-sectional view of a portion of the apparatus of FIG. 1 taken at the line 2—2.
Figure 3:
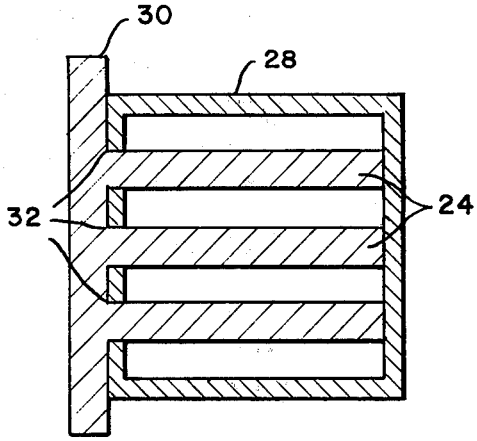
FIG. 3 is a cross-sectional view of a portion of the apparatus of FIG. 1 taken at the line 3—3.

Preferably, in the comminution of frangible material particles for the production of filter aid, each of the impact bars 24 has a characteristic impact dimension (projected width of the impact surface 34) of about 1.0 inches, and the bars 24 are grouped to have a centerline-centerline spacing of about 2.0 inches in the row 26. although the impact bars 24 are shown in FIGS. 1–3 with a square cross-section, the exact cross-sectional configuration can be any of a variety of shapes, and a particular shape can be chosen to provide an adverse pressure field of a given pattern according to analytical techniques well known to those of ordinary skill in the art of compressible fluid flow.

In accordance with the invention, and as is shown in FIG. 1, the plurality of spaced impact bars 24 can be grouped into a plurality of rows, as, for example, rows 36, 38 and 40 which are in addition to the aforementioned row 26. In this case, the bars in each of the rows downstream of the first (in this embodiment rows 36, 38 and 40 which are downstream of row 26), are mounted on the wall 28 of duct 20 or on frame 30 such as to be in staggered relationship with the bars in the immediately adjoining upstream rows. That is, a bar in row immediately downstream of another row should not be completely "shadowed" by the influence of the upstream bars on the flowing air and entrained particles 12.

As embodied herein, the centerline-centerline spacing between adjoining rows is about 2.0 inches for the embodiment of the invention where the characteristic impact dimension is about 1.0 inches and where the centerline-centerline spacing for the bars in a given row is about 2.0 inches.

It would be understood that the dimension and spacing of the impact bars, as well as the velocity of the air stream, will be determined by the relative masses of the particles to be comminuted and the desired final results. It is foreseeable, for example, that it might be advantageous to have the impact bars in succeeding rows graduated in width.

In accordance with the invention, and with reference to FIGS. 1 and 4, which depict the apparatus in operation, a method for selectivity comminuting particles of a frangible material such as for filter aid production is provided, which method includes the step of accelerating the particles to a high velocity in a substantially linear air stream. As embodied herein, the particles 12 are accelerated to a velocity above 4000 fpm and, preferably, to a velocity of about 4000 - 10,000 fpm. As described more fully in the preceeding sections, the acceleration can be accomplished by the use of a venturi connected to an airconveying system being used to transport the particles.

In accordance with the invention, and being another step in the method for selectively comminuting particles of a frangible material, the step of accelerating the particles 12 is followed by the step of establishing a plurality of adverse pressure fields for classifying the particles into a plurality of first fractions having particle masses greater than a predetermined value and a plurality of second fractions containing the rest of the particles. As embodied herein, the step of establishing a plurality of adverse pressure fields includes the steps of spacing stationary impact bars in at least one row perpendicular to the air stream and of directing the air stream and entrained particles toward these impact bars.

As was described previously and again with reference to FIG. 4, the pressure head 36 which is built up on the upstream face (impact surface 34) of the stationary bars causes a complex adverse pressure field with a two-dimensional gradient adverse to the motion of the incident air and unclassified frangible material particles 12. Hence, a given particle will not only experience a force tending to decelerate the particle along the flow path, but the particle will also be urged in a direction perpendicular to the flow path; that is, the flow path of a random particle in the vicinity of such a pressure field will curve away from the stationary impact bars. The amount of deflection of a particular particle is not large compared to its length of travel in the air stream, and thus the air stream remains substantially linear.

The path of an individual particle will depend upon its initial inertia (the product of the mass and velocity) and the strength of the gradient which, in turn, is dependent upon several factors including the air stream velocity, the dimensions of the impact bars and the transverse position of the incident particle relative to the field centerline. Although the exact relationship between the factors going to the determination of the path of a particle incident upon one of the plurality of adverse pressure field of this invention is complex, it can be determined by the use of suitable testing in a manner known to those of ordinary skill in the compressible fluid flow art.

In accordance with the invention, and with regard to the method of selectively comminuting particles, following the step of establishing of adverse pressure fields is the step of impacting the particles in the first fractions against stationary impact surfaces and causing fragmentation, the particles in the second fractions being deflected around and by-passing the stationary impact surfaces. As embodied herein, the impacting step includes the step of penetrating the pressure heads with the particles in the first fractions and the step of continuing the flow of these particles against the stationary impact surfaces which are the upstream faces 34 of spaced impact bars 24. As the particles will experience a retarding force within the adverse pressure field, the values of the controlling parameters must be chosen so that each particle, after penetrating the pressure head and arriving at the impact surface, has sufficient momentum to impact and be fragmented. Again, the exact relationship among the many factors influencing the path of the particle within the adverse pressure field is exceedingly complex, but standard testing procedures can be used to determine the values of particle velocity, stationary anvil means size and shape, etc., to achieve impact and fragmentation of all particles above a predetermined value.

In accordance with the invention, and to effect the final step in the method of selectively comminuting particles of a frangible material, there is carried out the step of recombining in the substantially linear air stream the impacted and fragmented particles in the first fractions with the by-passed particles in the second fractions. In the case shown in FIGS. 1–3 wherein anvil means 22 such as a plurality of impact bars 24 is used both to establish the adverse pressure fields and to impact the particles in the first fractions, the step of recombining is accomplished by allowing the impacted particles to re-enter, and become entrained in, the deflected air stream. As depicted in FIG. 4, the turbulent regions 46 immediately downstream of bodies such as the impact bars which are suspended in high velocity air streams, as opposed to air streams flowing in the laminar range, will be sufficient to provide both entrainment and good mixing downstream of the impact bars.

Also, in accordance with the invention, the method of selectively comminuting particles can further comprise repeating the steps of establishing adverse pressure fields, impacting and recombining until the mass of substantially all the particles are reduced below the predetermined value. In the apparatus shown in FIGS. 1–3, this repeating can be accomplished by not collecting the particles after the first set of impact bars but allowing the re-entrained particles to impinge upon the adverse pressure fields of the downstream impact bars.

Table 1 shows the results of several tests run on the apparatus of FIGS. 1–3 and tests run as a control using a conventional milling apparatus, but with all tests employing expanded perlite as the particulate frangible material. The impact bars had a square cross-sectional configuration, 1.0 inch in width. The spacings were 2.0 inches and, when multiple rows of bars were used, the spacing between rows was 2.0 inches.

TABLE I

| TEST NO. | A | B | C | D | E | F | G |
|---|---|---|---|---|---|---|---|
| 1. Conventional Mill | 75 | 14.5 | 8 | 86 | 56 | 1684 | 1200 |
| 2. 4 Rows of Bars | 71 | 14.5 | 12 | 72 | 56 | 1688 | |
| 3. 4 Rows of Bars | 72 | 14.5 | 8 | 82 | 56 | 1699 | |
| 4. Conventional Mill | 112 | 12.7 | 35 | 169 | 54 | 1735 | 900 |
| 5. Venturi; No Bars | 102 | 12.2 | 51 | 346 | 56 | 1769 | |
| 6. Conventional Mill | 75 | 15.6 | 6 | 110 | 50 | 1684 | |
| 7. 4 Rows of Bars | 97 | 13.9 | 13 | 122 | 55 | 1724 | |
| 8. 3 Rows of Bars | 98 | 14.2 | 12 | 100 | 51 | 1688 | |
| 9. 2 Rows of Bars | 93 | 13.9 | 14 | 75 | 50 | 1713 | |
| 10. 1 Row of Bars | 106 | 13.7 | 20 | 120 | 54 | 1705 | |

The first column A is a measure commonly employed in a laboratory which shows permeability. 100 on this scale equals 1 Darcy unit. This scale is proportional but not equal to the Darcy units.
The second column B is a measure of the cake density of the material in pounds per cubic foot.
The third column C indicates the amount of material in milliliters which will float in water when 20 grams of the material are suspended in 250 ml water in a graduated flask.
The fourth column D indicates coarse heavy material trapped out by the first air separator following the milling device in kilograms per hour.
The fifth column E is the loose bulk density of the expanded perlite in kilograms per cubic meter.
The sixth column F is the perlite expander furnace feed rate in kilograms per hour.
The seventh column G indicates the RPM of the conventional mill which was used for the control tests. It should be mentioned in connection with this column that the impact bar milling apparatus used in the tests indicated in this table was installed parallel to the conventional mill so that material going through the impact bars did not go through the mill.

With reference to Table I, it will be noted that runs 1, 4 and 6 indicated normal operation of the plant according to the prior art without the use of the invention. In these cases, the expanded perlite was milled by a conventional milling device and no material passed through the impact bar system. Runs 2, 3 and 7 show the use of four rows the bars when these were used as the primary milling device with the main stream of material not going through the conventional mill. Note that in the case of run 2 there was a slight decrease in the permeability, no change in cake density, a slight increase in float and a decrease in the amount of coarse heavy material trapped out of the system. Run 7 shows that four rows of impact bars resulted in slightly less milling than in the conventional mill. Permeability and float were higher than normal and cake density was lower. Run 10, using only one row of impact bars showed a major increase in permeability and float with a corresponding decrease in cake density.

It will be apparent to those skilled in the art that various modifications and changes can be made in both the apparatus and the method of this invention without departing from either the scope or spirit of this invention.

What is claimed is:

1. An apparatus for selectively comminuting particles of frangible material comprising:

a. air-conveying means for carrying in an air stream entrained frangible material particles of varying means;

b. accelerating means communicating with said air-conveying means for increasing the velocity of said air stream and said entrained particles; and c. anvil means for establishing a plurality of adverse fields in said accelerated air stream for differentiating said entrained particles according to mass and for impacting particles according to mass and for impacting particles above a predetermined mass and for by-passing the rest of said particles, said impacted particles being fragmented upon impact wherein said anvil means includes a plurality of spaced impact bars, each of said bars having a substantially flat impact surface, and each of said impact bars extending across substantially an entire width of said air stream, said impact bars being grouped to form at least one row oriented substantially perpendicular to said accelerated air stream.

2. The apparatus of claim 1 wherein said accelerating means includes:

a venturi; and b. a duct fluidly connected to the exit of said venturi, said anvil means being located in said duct, and said impacted and fragmented particles becoming re-entrained in said accelerated air stream and being carried through said duct together with said by-passed particles in said accelerated air stream.

3. The apparatus of claim 2 wherein the longitudinal axis of said duct is substantially linear, and wherein the cross-sectional area of said duct is substantially constant along the longitudinal axis.

4. The apparatus of claim 1 wherein said particles are accelerated by said accelerating means to a velocity above about 4000 fpm.

5. The apparatus of claim 4 wherein said particles are accelerated by said accelerating means to a velocity of about 4000 to 10,000 fpm.

6. The apparatus of claim 1 wherein:

a. said impact bars have a characteristic impact surface width of about 1.0 inches; and b. the spacing, centerline-centerline, of said bars in said at least one row is about 2.0 inches.

7. The apparatus of claim 1 including a plurality of rows of impact bars spaced along the longitudinal axis of said air stream, said impact bars in any two adjoining rows being in staggered relationship.

8. The apparatus of claim 7 wherein:

a. said impact bars have a characteristic impact surface width of 1.0 inches;

b. the spacing, centerline-centerline, of said bars in each of said rows is about 2.0 inches; and c. the spacing, centerline-centerline, of said adjoining rows along said air stream is about 2.0 inches.

9. An apparatus for selectively comminuting particles of a frangible material for the production of filter aid, the apparatus comprising:

a. air-conveying means for carrying in an air stream entrained particles of varying masses;

b. accelerating means communicating with said air-conveying means for increasing the velocity of said air stream and said entrained particles to about 4000 fpm to 10,000 fpm, said accelerating means including a venturi, and said accelerating means also including a duct fluidly connected to the exit of said venturi, the longitudinal axis of said duct being substantially linear and the cross-sectional area of said duct being substantially constant along the longitudinal axis; and c. anvil means mounted in said duct for establishing a plurality of adverse pressure fields in said accelerated air stream for differentiating said entrained particles according to mass and for impacting and fragmenting particles above a predetermined mass and for by-passing the rest of said particles, said anvil means including a plurality of spaced impact bars grouped to form a plurality of rows, each of said impact bars extending across substantially an entire width of said duct, the impact surface of each of said impact bars being substantially flat, said rows being spaced along the longitudinal axis of said duct and being oriented substantially perpendicular to the longitudinal axis of said duct, and said bars in any adjacent pair of said spaced rows being in staggered relationship, said impacted and fragmented particles becoming re-entrained in said accelerated air stream and being carried through said duct along with said by-passed particles by said accelerated air stream.

10. The apparatus of claim 9 wherein:

a. said bars have a characteristic impact surface width of 1.0 inches;

b. the spacing, centerline-centerline, of said bars in each of said rows is about 2.0 inches; and c. the spacing, centerline-centerline, of said rows along said duct is about 2.0 inches.

11. A method for selectively comminuting particles of frangible material being carried by an airconveying system, said method comprising the steps of:

a. accelerating said particles in a substantially linear air stream;

b. classifying said particles within said linear air stream into a plurality of first fractions and second fractions, said first fractions including substantially all particles having a mass greater than a predetermined value, and said second fractions including the rest of said particles, wherein the step of classifying said particles includes the further steps of i. spacing stationary impact bars each having a substantially flat impact surface in at least one row substantially perpendicular to said air stream, extending each of said bars across substantially an entire width of said air stream, and orienting each of said impact bars with said flat impact surface facing in a direction to oppose the flow in said accelerated air stream;

ii. directing said air stream with said entrained particles toward said impact bars, a pressure head building up on said impact surfaces, and said pressure heads creating adverse pressure fields deflecting particles in said second fractions around said bars;

c. impacting said particles in said first fractions against said stationary impact surfaces, wherein said step of impacting includes the further steps of i. penetrating said pressure heads with said particles in said first fractions; and ii. continuing the flow of said particles in said first fractions against said stationary impact surfaces with sufficient particle energy to effect fragmentation; and d. re-combining in said linear air stream said impacted and fragmented particles in said first fractions with said by-passed particles in said second fractions.

12. The method of claim 11 wherein said particles are accelerated to a velocity above about 4000 fpm.

13. The method of claim 12 wherein said particles are accelerated to a velocity of about 4000 fpm to 10,000 fpm.

14. The method of claim 11 wherein the steps of classifying, impacting and re-combining are repeated until the masses of substantially all of said particles in said first fractions are reduced below said predetermined value.

15. A method for selectively comminuting particles of a frangible material for the production of filter aid, said particles being carried by an air-conveying system, said method comprising the steps of:

a. accelerating said particles to a velocity of about 4000 to 10,000 fpm in a substantially linear air stream;

b. classifying said particles within said linear air stream into a plurality of first fractions and second fractions, said first fractions including substantially all particles having a mass greater than a predetermined value, and said second fractions including the rest of said particles, said classifying step including the steps of:

1. spacing stationary bars each having a substantially flat impact surface in a row substantially perpendicular to said air stream, extending each of said bars across substantially the entire width of said air stream, and orienting each of said impact bars with said impact surface facing in a direction to oppose the flow in said accelerated air stream; and 2. directing said air stream with said entrained particles toward said spaced bars, a pressure head building up on the impact surface of each of said bars, said pressure heads creating adverse pressure fields for deflecting particles in said second fractions around said bars;

c. impacting said particles in said first fractions against said impact surfaces, said impacting step including the steps of:

1. penetrating said adverse pressure fields with said particles in said first fractions; and 2. continuing the flow of said particles in said first fractions against said stationary impact surfaces with sufficient particle energy to effect fragmentation; and d. re-combining in said linear air stream said bypassed particles having a mass less than said predetermined value with said impacted particles.

16. The method of claim 15 wherein the steps of spacing, directing, penetrating, continuing and re-combining are repeated until the masses of substantially all of said particles are below a predetermined value.

* * * * *

UNITED STATES PATENT AND TRADEMARK OFFICE

CERTIFICATE OF CORRECTION

PATENT NO. : 4,059,231
DATED : November 22, 1977

INVENTOR(S) : Ernest L. Neu

It is certified that error appears in the above-identified patent and that said Letters Patent are hereby corrected as shown below:

Column 8, line 53, after "adverse", insert ---pressure---.

Column 8, line 68, insert ---a.--- before "a".

Column 10, line 8, change "airconveying" to ---air-conveying---.

Signed and Sealed this

*Fourteenth* Day of *March 1978*

[SEAL]

*Attest:*

RUTH C. MASON
*Attesting Officer*

LUTRELLE F. PARKER
*Acting Commissioner of Patents and Trademarks*